US006027209A

United States Patent [19]

Menendez et al.

[11] Patent Number: 6,027,209

[45] Date of Patent: Feb. 22, 2000

[54] ORDERED STORAGE AND/OR REMOVAL OF INKJET CARTRIDGES AND CAPPING MEANS FROM A STORAGE CONTAINER

[75] Inventors: Jorge Menendez; Jordi Bartolome, both of Sant Cugat, Spain

[73] Assignee: Hewlett-Packard Company, Palo Alto, Calif.

[21] Appl. No.: 08/922,538

[22] Filed: Sep. 3, 1997

[51] Int. Cl.[7] ..... B41J 2/175

[52] U.S. Cl. ..... 347/85; 347/29; 347/152

[58] Field of Search ..... 347/22, 32, 29, 347/33, 49, 85, 86, 87, 152

[56] References Cited

U.S. PATENT DOCUMENTS 5,587,729 12/1996 Lee et al. ..... 347/32
5,801,725 9/1998 Neese et al. ..... 347/32

*Primary Examiner*—N. Le
*Assistant Examiner*—Anh T. N. Vo
*Attorney, Agent, or Firm*—David S. Romney

[57] ABSTRACT

A storage container and method of storing inkjet cartridges and removable capping means therefor in which the order of their insertion and/or removal is controlled. Preferably, both the order of insertion of a cartridge and its capping means and the order of removal of said cartridge and capping means are controlled so that a cap and a printhead of a cartridge engage and disengage by the movement of the printhead towards or away from the cap thus preventing damage to the printhead by movement of the cap or any of the other components of a service module against the printhead. A rotatable arm mounted on the storage container which abuts a cartridge and obstructs the removal and/or insertion of the capping means is disclosed for controlling said order of insertion and removal.

14 Claims, 18 Drawing Sheets

FIG. 5
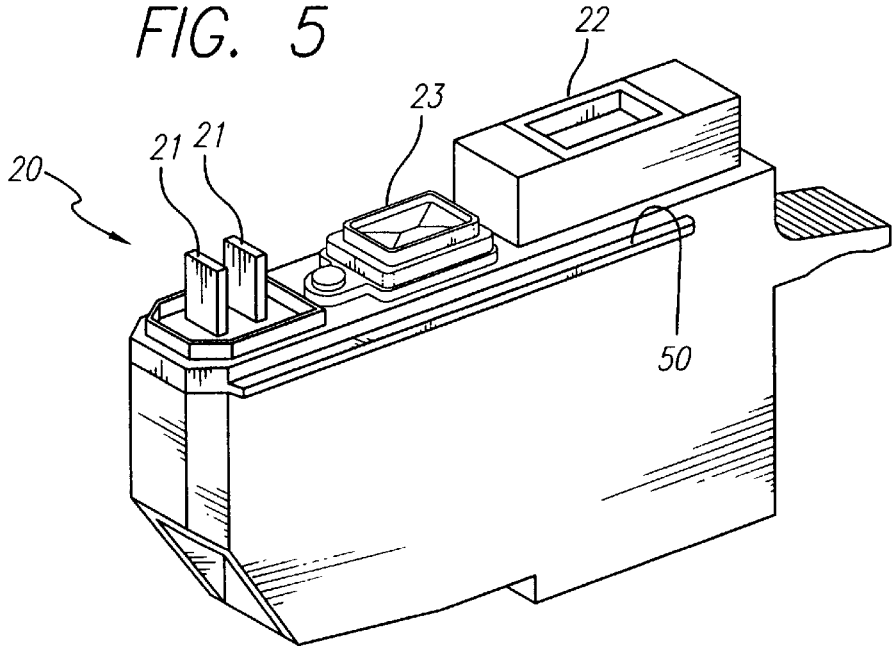
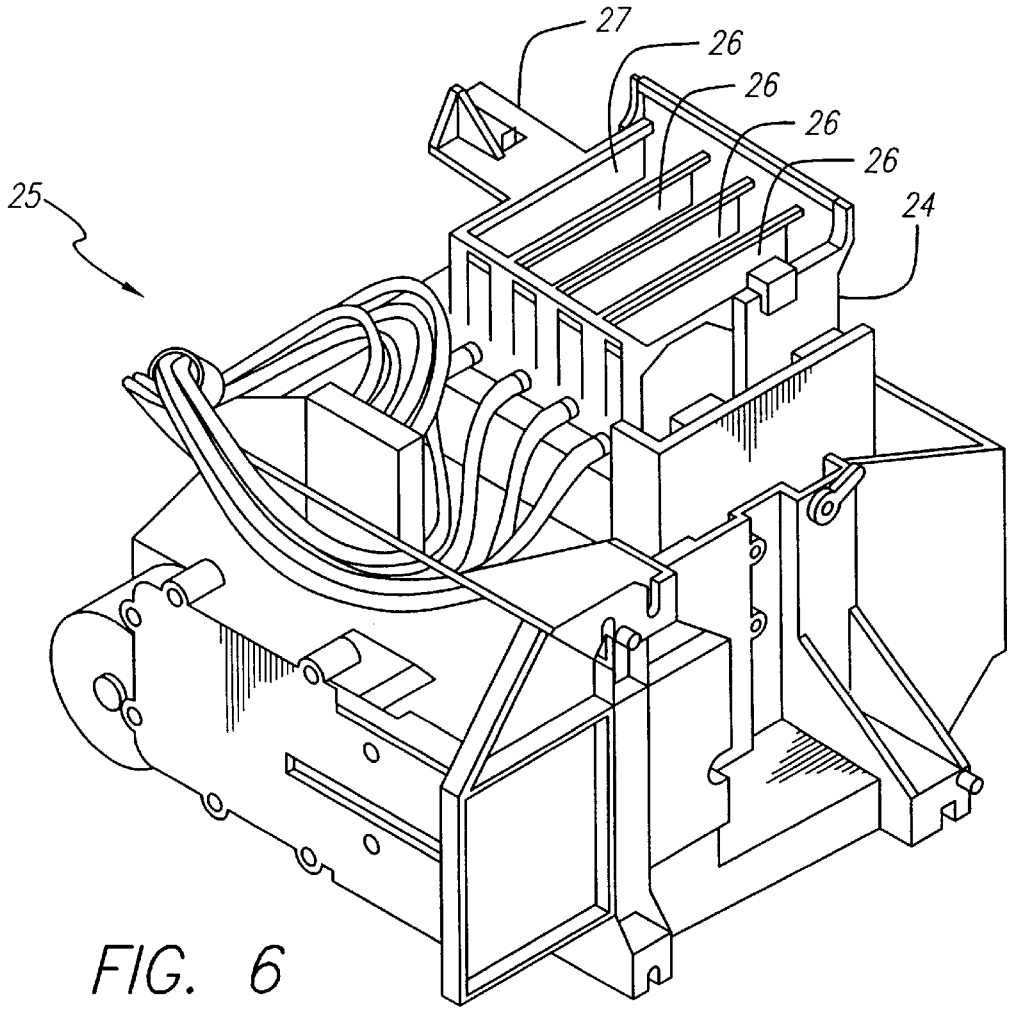
FIG. 6

FIG. 7A
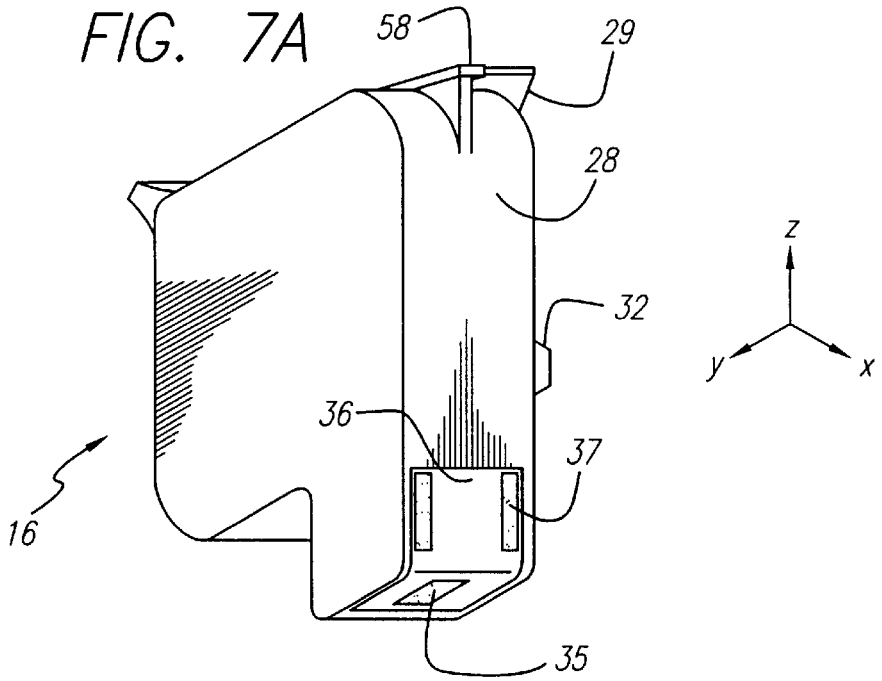
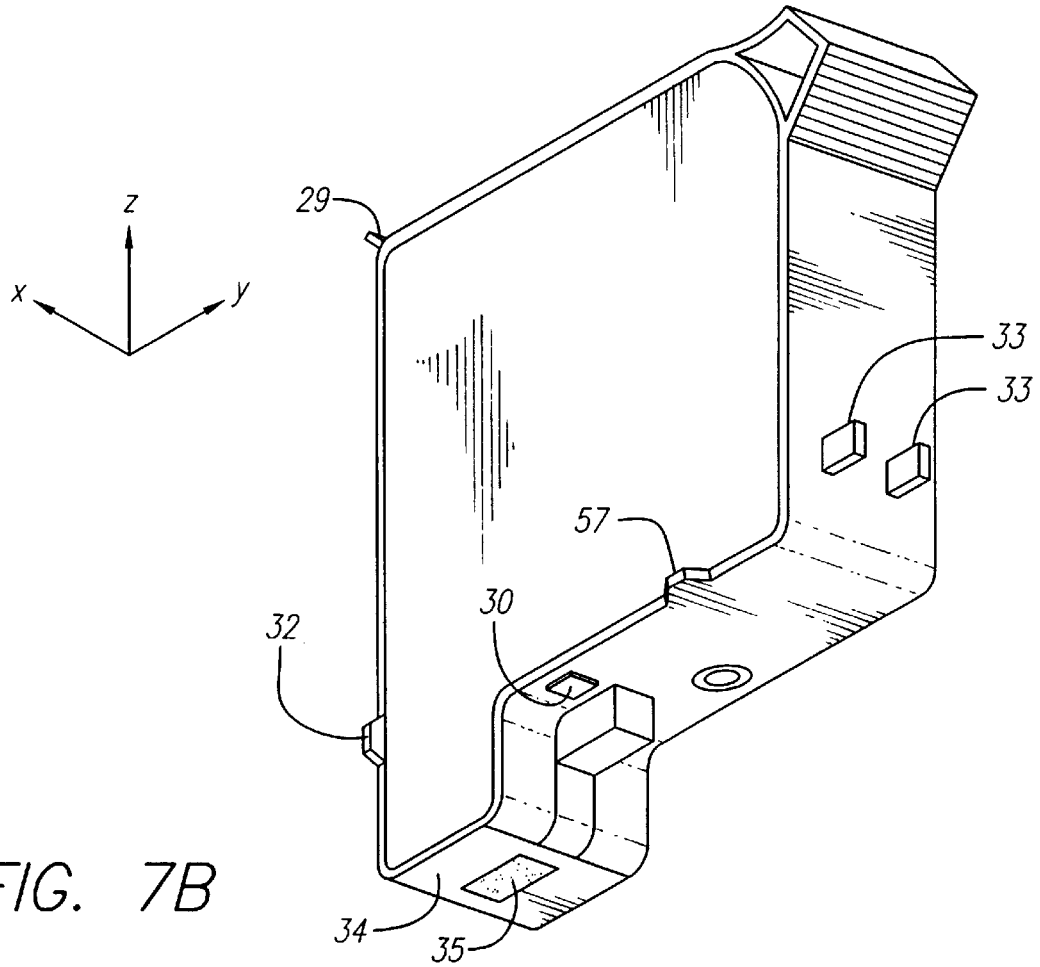
FIG. 7B

ORDERED STORAGE AND/OR REMOVAL OF INKJET CARTRIDGES AND CAPPING MEANS FROM A STORAGE CONTAINER

CROSS-REFERENCE TO RELATED APPLICATIONS

The present application is related to the following co-pending commonly assigned applications, all of which are incorporated herein by reference: Ser. No. 08/922,782 entitled A STORAGE CONTAINER FOR INKJET CARTRIDGES HAVING CLEANING MEANS AND A METHOD FOR STORING INKJET CARTRIDGES filed Sep. 3, 1997 by Jordi Bartolome et al, Ser. No. 08/923,213 entitled A STORAGE CONTAINER FOR INKJET CARTRIDGES HAVING REMOVABLE CAPPING MEANS AND A METHOD FOR STORING INKJET CARTRIDGES filed Sep. 3, 1997 by Jordi Bartolome et al, and Ser. No. 08/922,542 entitled A STORAGE CONTAINER FOR A PLURALITY OF INKJET CARTRIDGES AND A METHOD FOR STORING INKJET CARTRIDGES filed Sep. 3, 1997 by Jordi Bartolome et al.

FIELD OF THE INVENTION

The present invention relates to the storage of inkjet cartridges used in inkjet printers when such cartridges are removed from the carriage of the printer, and in particular to a storage container and method of storing cartridges and removable capping means therefor in which the order of their insertion and/or removal is controlled.

BACKGROUND TO INVENTION

Inkjet cartridges are now well known in the art and generally comprise a body containing an ink supply and having electrically conductive interconnect pads thereon and a printhead for ejecting ink through numerous nozzles. In thermally activated inkjet cartridges, each cartridge has heater circuits and resistors which are energised via electrical signals sent through the interconnect pads on the cartridge. Each inkjet printer typically has a plurality, normally four, of cartridges each one having a different colour ink supply for example black, magenta, cyan and yellow, removably mounted in a carriage which scans backwards and forwards across a print medium, for example paper, in successive swaths. When the scanning carriage correctly positions one of the cartridges over a given location on the print medium, a jet of ink is ejected from a nozzle to provide a pixel of ink at a precisely defined location. The mosaic of pixels thus created provides a desired composite image.

The cartridges must thus be held within the scanning carriage of the printer very precisely, so that their position over the print media is accurately known. This is normally achieved by utilising a cartridge holder, forming part of the scanning carriage, which has a number of biasing means for biasing datums on the cartridge against datums on the cartridge holder, see for example U.S. Pat. No. 5,642,143. Furthermore reliable and repeatable electrical contact must be made between the printer and the cartridge, via the carriage. Generally, a flexible insulating tape having electrically conductive pads (also known as a flex circuit) is attached to the cartridge holder and this is arranged so that the electrically conductive interconnect pads on a cartridge make contact with the pads on the flex circuit when the cartridge is inserted into the carriage of the printer, as described for example in U.S. Pat. No. 5,461,482.

Inkjet cartridges are increasingly becoming more sophisticated and complex in their construction and longer lifetimes are also required of cartridges, particularly those for use with printers having an off-carriage ink reservoir which replenishes the cartridge's ink supply. This has lead to greater sophistication in the so-called "servicing" of cartridges by a printer. It is normal for printers to have a service station at which various functions are performed on the cartridges while they are mounted in the printer carriage such as wiping, spitting and capping, see for example U.S. Pat. No. 5,585,826. Wiping comprises moving a wiper of a specified material across the printhead of a cartridge to remove paper dust, ink spray and the like from the nozzle plate of the printhead. Spitting, ejecting ink into a spittoon in the service station, is performed to prevent ink in nozzles which have not been fired for some time from drying and crusting. Cartridges are capped by precisely moving the carriage, and often the cap too, within the service station, so that the cap mates with the printhead and forms a seal around the nozzle plate. Capping prevents ink on the printhead and in the nozzles from drying by providing the correct atmosphere around these components and thus reduces the risk of crusting and ink plug formation in the nozzles. Often, each cartridge will have its own servicing components, for example wiper and cap, within the service station so that contamination of these components for example by different coloured inks does not occur. These servicing components are also often replaceable, either individually or as a unit, so that they can be changed during the lifetime of the printer, or even (given presently achieved longer cartridge lifetimes) when the cartridge is replaced, so as to maintain high quality cartridge servicing functions within the printer.

This same degree of care in maintaining the functionality of inkjet cartridges when mounted in the carriage of a printer has not been applied to the design of storage containers, also known as garages, for storing inkjet cartridges when removed from an inkjet printer carriage. There are a number of circumstances when there is a requirement for removing a partially used cartridge from a printer for storage, for example to utilise a colour cartridge instead of a black one in single cartridge printers, to replace a cartridge or cartridges for printing text by ones for printing photographic images, or by ones containing specialised ink, for example ink that is resistant to deterioration by ultra-violet light. Despite these requirements, cartridge garages have remained relatively unsophisticated. Prior art cartridge garages comprise a compartment for storing a single cartridge and a permanent cap for capping the cartridge. An example of a prior art cartridge garage is shown in FIG. 1. This garage is sold under part number C2621-60007 by Hewlett-Packard and is intended for the storage of cartridges used with Hewlett-Packard's Portable DeskJet 310 inkjet printer. The garage may store one of either a black inkjet cartridge 1 or a colour inkjet cartridge 2 and has two permanent caps (not shown) mounted at the base of the garage which are not designed to be removed by the user. The garage also has two springclips 3 and 4 for respectively retaining one of either the black 1 or colour 2 cartridge.

BRIEF SUMMARY OF THE INVENTION

The printhead of an inkjet cartridge is a complex and somewhat fragile component of the cartridge. This printhead must nevertheless be capped, as discussed above, both when in a printer (when not printing) and particularly when being stored in a garage. In the co-pending commonly assigned related application Atty Docket 6097027 entitled A STORAGE CONTAINER FOR INKJET CARTRIDGES HAVING REMOVABLE CAPPING MEANS AND A METHOD FOR STORING INKJET CARTRIDGES by Jordi Bartolome et al, it is suggested that the capping means for capping a cartridge in a garage is designed to be manually removable from the garage. While there are many advantages to this arrangement, described in detail in the aforementioned application, there is a danger that if the capping means is moved against the printhead of a cartridge it may damage the printhead. This problem is exacerbated if the capping means is mounted on a service module which also comprises other components, such as wipers, which may inadvertently engage the printhead.

The present invention addresses this issue and provides means for controlling the order of insertion and/or removal of cartridges and capping means from a storage container so that in use a particular capping means is inserted into the container prior to the insertion of its associated inkjet cartridge and/or so that a particular inkjet cartridge is removed from the container prior to the removal of its associated capping means. Preferably, both the order of insertion of a cartridge and its capping means and the order of removal of said cartridge and capping means are controlled. By controlling the order of insertion and removal of cartridges and capping means into the garage it is ensured that a cap and a printhead will engage and disengage by the movement of a printhead towards or away from a cap thus preventing damage to the printhead by movement of the cap or any of the other components of a service module against the printhead.

Preferably the ordering means comprises an arm movable between a first position in which the capping means may be inserted into and/or removed from said capping housing and a second position in which the arm obstructs the removal and/or insertion of the capping means, the abutment of said arm against an inkjet cartridge preventing its movement from said second position to said first position.

In a further aspect the invention provides a storage container having locking means for substantially preventing movement of a capping means located in a capping housing of the storage container when the inkjet cartridge associated with said capping means is located in said cartridge housing of the storage container. Hence potential damage to the printhead of a cartridge is avoided since motion of the capping means is substantially prevented while the cartridge is located in the garage.

The invention also provides a method for storing inkjet cartridges and a method for removing inkjet cartridges from a storage container.

A more complete understanding of the present invention and other objects, aspects, aims and advantages thereof will be gained from a consideration of the following description of the preferred embodiment read in conjunction with the accompanying drawings provided herein

BRIEF DESCRIPTION OF THE DRAWINGS

FIG. 5 is a perspective view of a service module which may be used in a printer and stored in the garage of the invention.

FIG. 6 is a perspective rear view of the service station unit of the printer of FIG. 2.

FIGS. 7A and 7B show an inkjet cartridge which may be used in a printer and stored in the garage of the present invention.

DETAILED DESCRIPTION OF THE PREFERRED EMBODIMENT OF THE INVENTION

Figure 1:
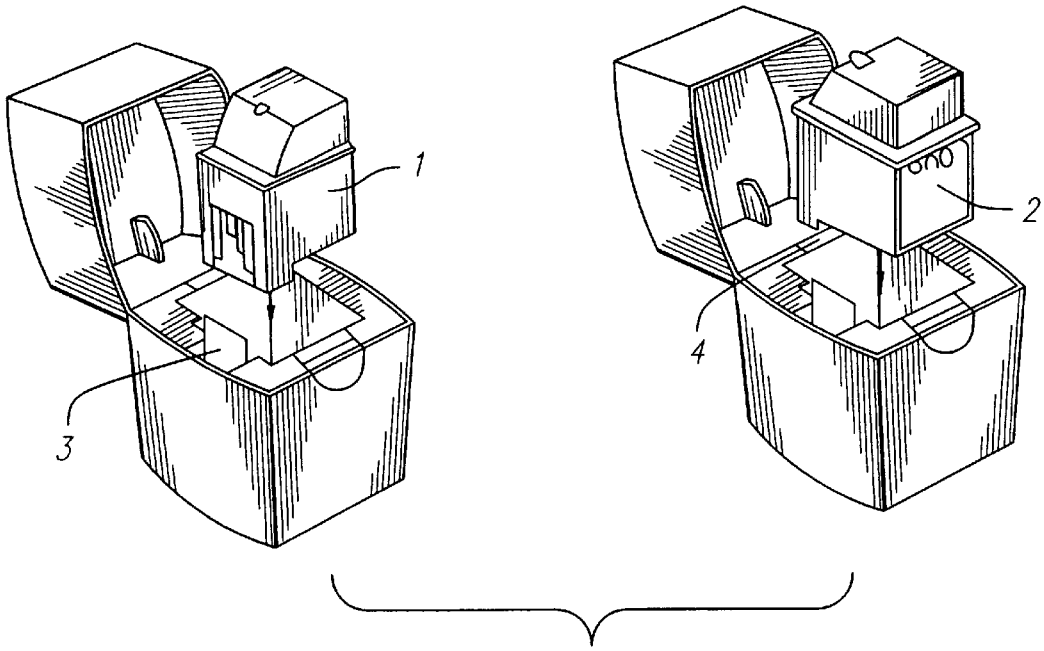
FIG. 1 shows a prior art garage for storing a single inkjet cartridge.

While the present invention is open to various modifications and alternative constructions, he preferred embodiments shown in the drawings will be described herein in detail. It is to be understood, however, that there is no intention to limit the invention to the particular form disclosed. On the contrary, the intention is to cover all modifications, equivalences and alternative constructions falling within the spirit and scope of the invention as expressed in the appended claims.

Figure 2:
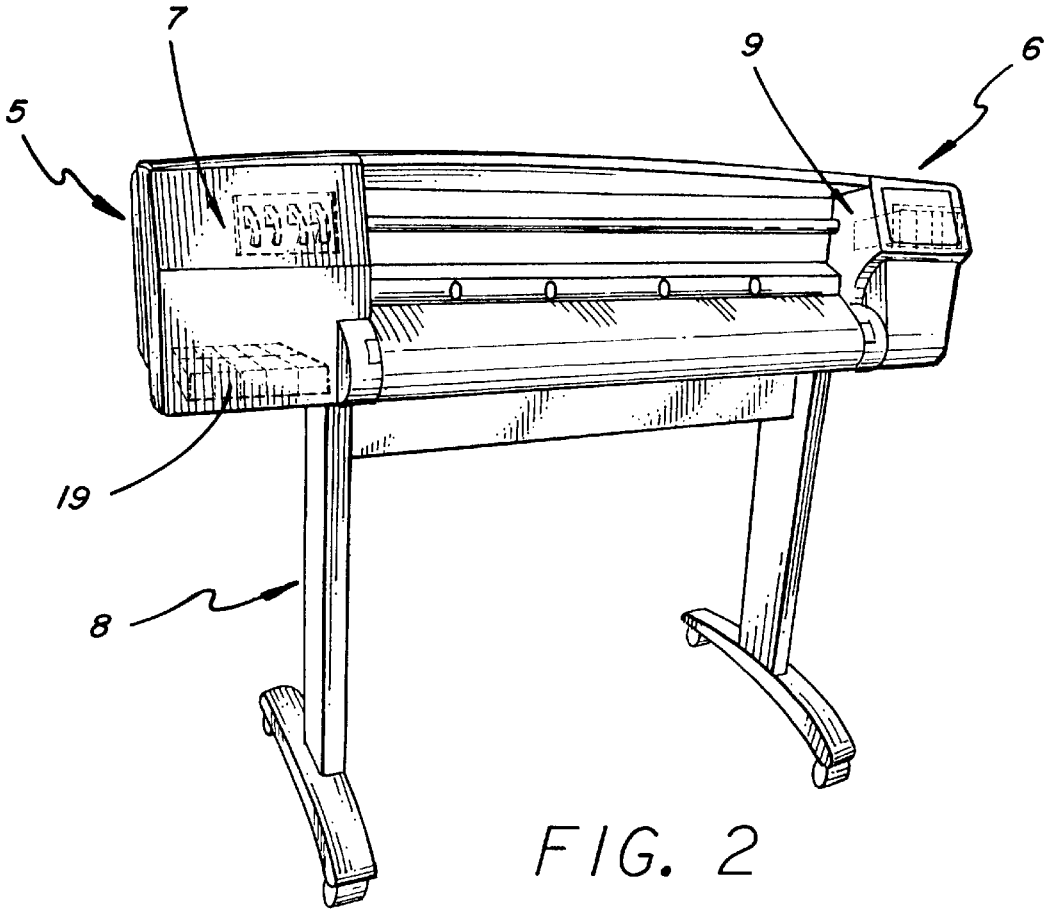
FIG. 2 is a perspective view of a large-format inkjet printer with which the garage of the present invention may be utilised.

It will be appreciated that the garage of the present invention may be used with virtually any inkjet printer, however one particular inkjet printer of the type with which the garage of the present invention may be used will first be described in some detail, before describing the garage, since this will allow the construction and function of the garage to be better understood FIG. 2 shows a perspective schematic view of a thermal inkjet large-format printer having a housing 5 with right and left covers respectively 6 and 7, mounted on a stand 8. A print media such as paper is positioned along a vertical or media axis by a media axis drive mechanism (not shown). As is common in the art, the media drive axis is denoted as the X axis and the carriage scan axis is denoted as the Y axis.

Figure 3:
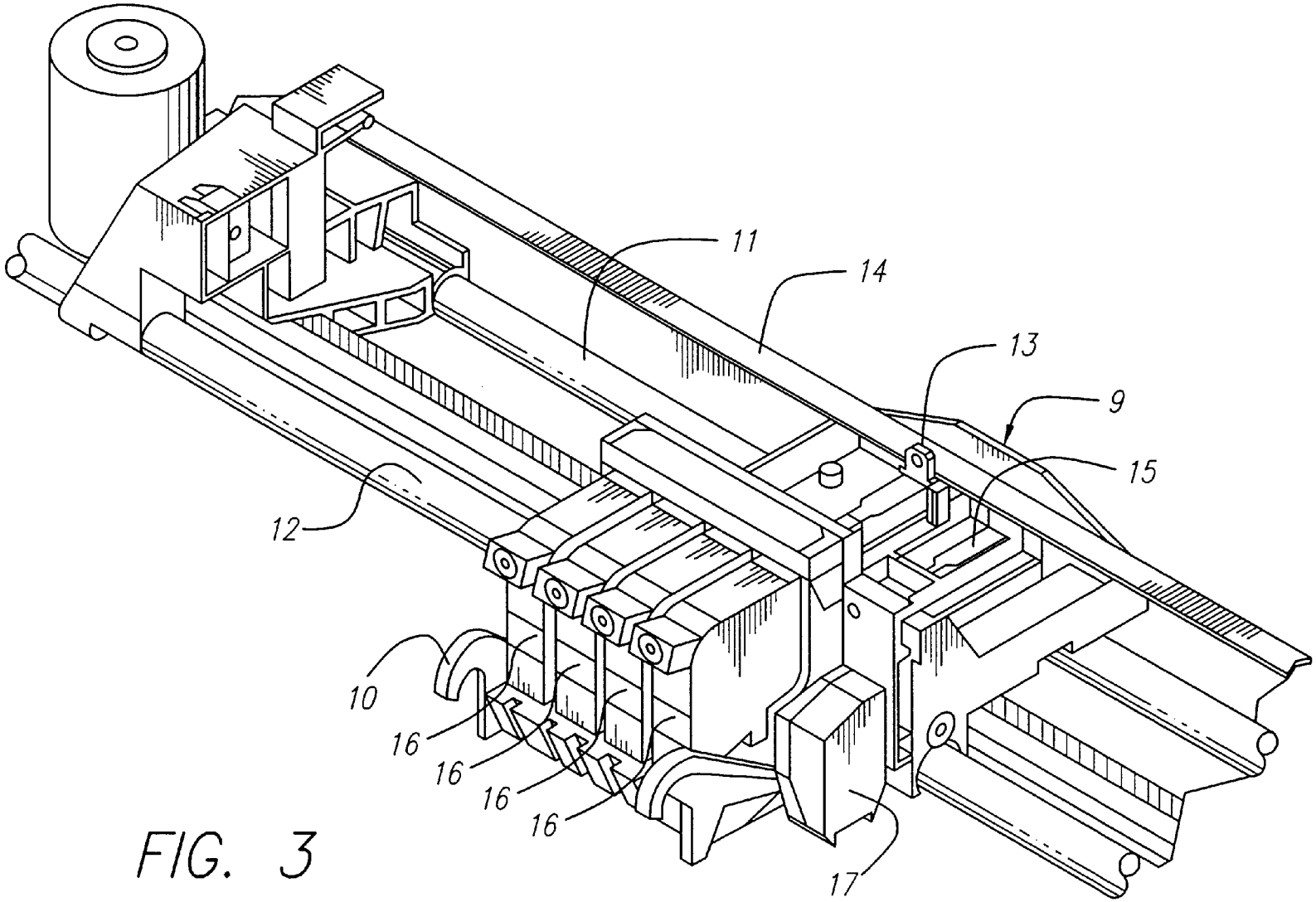
FIG. 3 is a schematic drawing of components within the print zone of the printer of FIG. 2.
Figure 4:
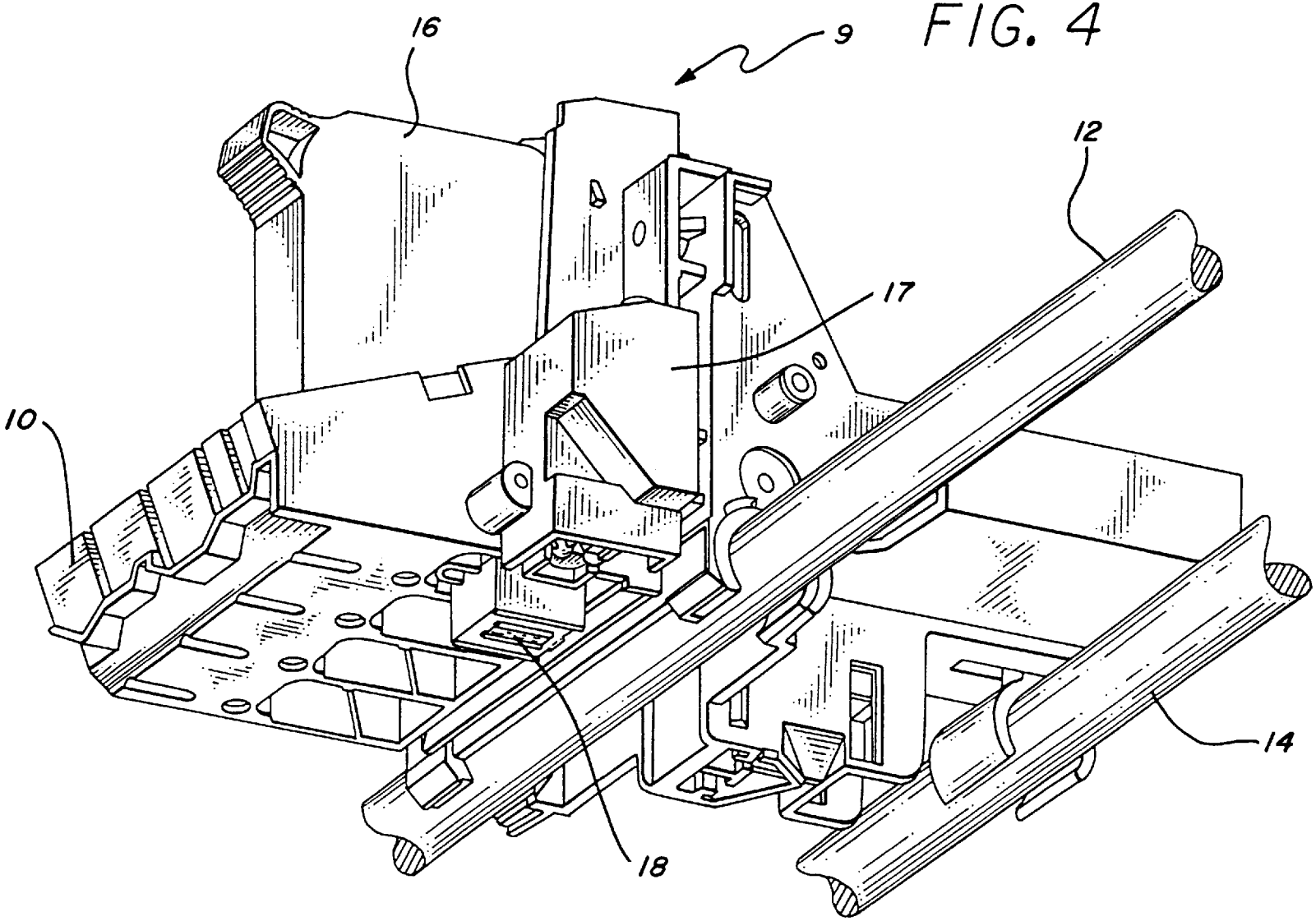
FIG. 4 is a side bottom view of the carriage assembly of the printer of FIG. 2.

The printer has a carriage assembly 9 shown in phantom under cover 6 and more clearly in FIG. 3 which is a perspective view of the print zone of the printer. The carriage assembly 9 has a body which is mounted for reciprocal movement along slider rods 11 and 12 and a cartridge holder 10 for holding four inkjet cartridges 16 each holding ink of a different colour for example black, yellow, magenta and cyan. The cartridges are held in a close packed arrangement and each may be selectively removed from the cartridge holder 10 for replacement by a fresh cartridge. The printheads of the cartridges 16 are exposed through openings in the cartridge holder 10 facing the print media. On the side of the cartridge holder 10 is mounted an optical sensor 17 for optically sensing test patterns printed by the cartridges 16. The carriage assembly body further retains an optical encoder 13 for determining the position of the carriage in the Y axis by interaction with an encoder strip 14, and the circuitry 15 required for interface to the heater circuits in the inkjet cartridges 16. FIG. 4 is a side-bottom perspective view of the carriage assembly 9 which better shows the mounting of the carriage and the protrusion of a printhead 18 of an inkjet cartridge 16 through the cartridge holder 10 towards the print media.

Referring again to FIG. 2 the printer has a set of replaceable ink supply modules 19 in the lefthand side of the printer (shown in phantom under the cover 7) and a set of replaceable service station modules mounted in the service station at the righthand side of the printer (not shown). FIG. 5 shows a service station module 20 having dual wipers 21 at one end, a spittoon 22 at the other end and a cap 23 at an intermediate position. The printer has one service station module 20 per cartridge and each service station module is mounted in a service station carriage 24, shown in FIG. 6, in the service station unit 25 of the printer. The service station carriage 24 has four slots 26 for receiving service modules 20. The whole of the service station carriage is moved in two directions in a complex manner by the service station unit 25 so as to engage and disengage the carriage assembly 9 when required for servicing of the cartridges 16 The movement of the service station carriage 24 is detected by means of a motion sensor mounted on an arm 27 extending from the side of the carriage 24.

Further details of printers of the type described are disclosed in the co-pending commonly assigned application Ser. No. 08/810,485 by Rick Becker et al, filed on Mar. 3, 1997 entitled INKJET PRINTING WITH REPLACEABLE SET OF INK-RELATED COMPONENTS (PRINTHEAD/SERVICE MODULE/INK SUPPLY) FOR EACH COLOR OF INK which is incorporated herein by reference.

FIGS. 7A and 7B show an inkjet cartridge 16 which can be stored in the garage of the present invention. The cartridge has a body 28 having an internal ink supply and various alignment features or datums 29, 30, 31, 32, 57 and 58 and keying elements 33. The printhead 34 has a nozzle plate 35 and an insulating tape 36 having electrically conductive interconnect pads 37 thereon.

Figure 8:
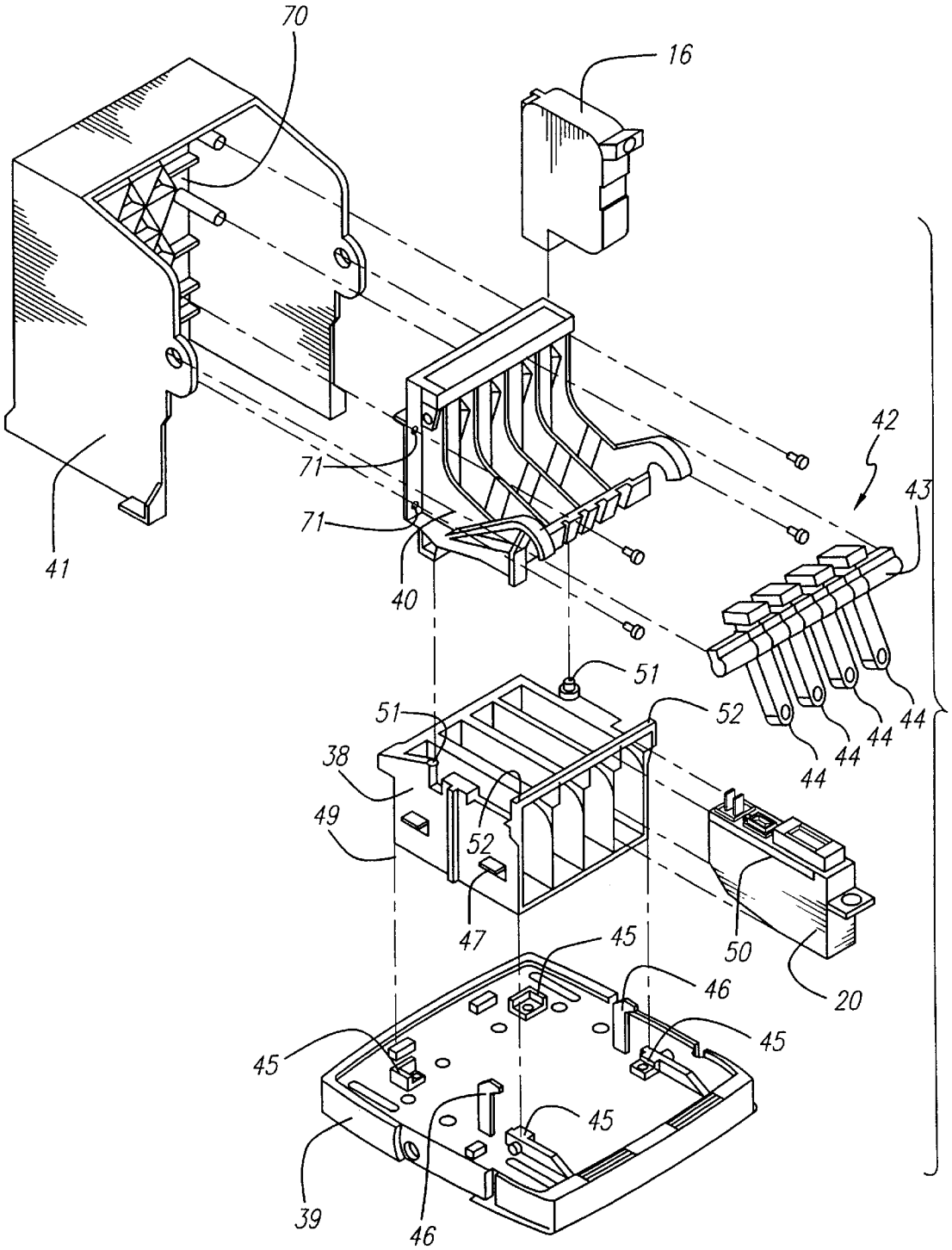
FIG. 8 is an exploded perspective view of the garage of the present invention showing its component parts.

Referring now to FIG. 8, which shows an exploded view of a garage according to an embodiment of the present invention, the garage has a capping housing 38 mountable on a base plate 39, a cartridge holder 40 mountable on the capping housing 38, a casing 41 to which the cartridge holder 40 is fixable, and ordering means 42. The ordering means 42 comprise a bar 43 mountable on the casing 41 and four locking arms 44 rotatably mounted on the bar 43. Also shown in FIG. 8 are a cartridge 16 and a service module 20 which may be stored in the garage. The garage is shown assembled in FIG. 9, expect for the casing 41 which is not shown so that the interaction of the other components can be better seen.

When a service module 20 and a cartridge 16 are stored in the garage the printhead 34 of the cartridge engages the cap 23 of the service module 20 in the same manner as it does when the two are brought together in a printer and thus the printhead is protected by a cap which has been specifically designed for the particular type of cartridge and which has been used only with that particular cartridge, either in the printer or in the garage. As can be seen from FIG. 9, four cartridges and four service modules may be stored simultaneously as a set in the garage.

As shown in FIG. 8 the base plate has locating points 45 for each of the four corners 49 of the capping housing 38 and flexible locking members 46 which engage with ledges 47 on either side of the capping housing 38. The capping housing 38 is mounted to the base plate 39 by placing both the front corners 49 onto the front locating points 45 and then rotating the capping housing downwardly and backwardly so that the rear corners 49 of the capping housing 38 are placed into the rear locating points 45 of the base plate as the flexible locking members 46 snap into engagement with the ledges 47, thus holding the capping housing 38 firmly to the base plate 39. The capping housing can be seen in this fixed position in FIG. 10. At the top of the capping housing 38 are a pair 51 of freestanding upwardly extending referencing points and a pair 52 of linked upwardly extending referencing points. Once the capping housing is in place, the cartridge holder 40 is placed on top of the capping housing so that reference points 51, 52 on the top of the capping housing engage reference surfaces (not shown in FIG. 8) on the bottom of the cartridge housing. This ensures that these two components are mated correctly and thus that cartridges placed in the cartridge holder accurately engage the cap of a respective service module to protect the cartridges fragile printhead without risk of damage.

The casing 41 is then placed over both the cartridge holder 40 and the capping housing 38 and is fixed to the base plate 39. It should be noted that the cartridge holder 40 is not fixedly mounted to the capping housing 38 but simply rest against it and is fixed to the rear wall 70 of the casing 41 by screws which pass through four mounting points 71 on the cartridge holder. During the fixing of the cartridge holder to the rear wall 70 of the casing 40, the cartridge holder is manually biased downwardly onto the capping housing so that the referencing surfaces on the cartridge holder make good contact with those on the capping housing. There is also provided a cover which is mountable over the whole of the garage and can be locked in place by rotation of the two levers 69 (one is shown) on either side of the base plate 39.

Figure 10:
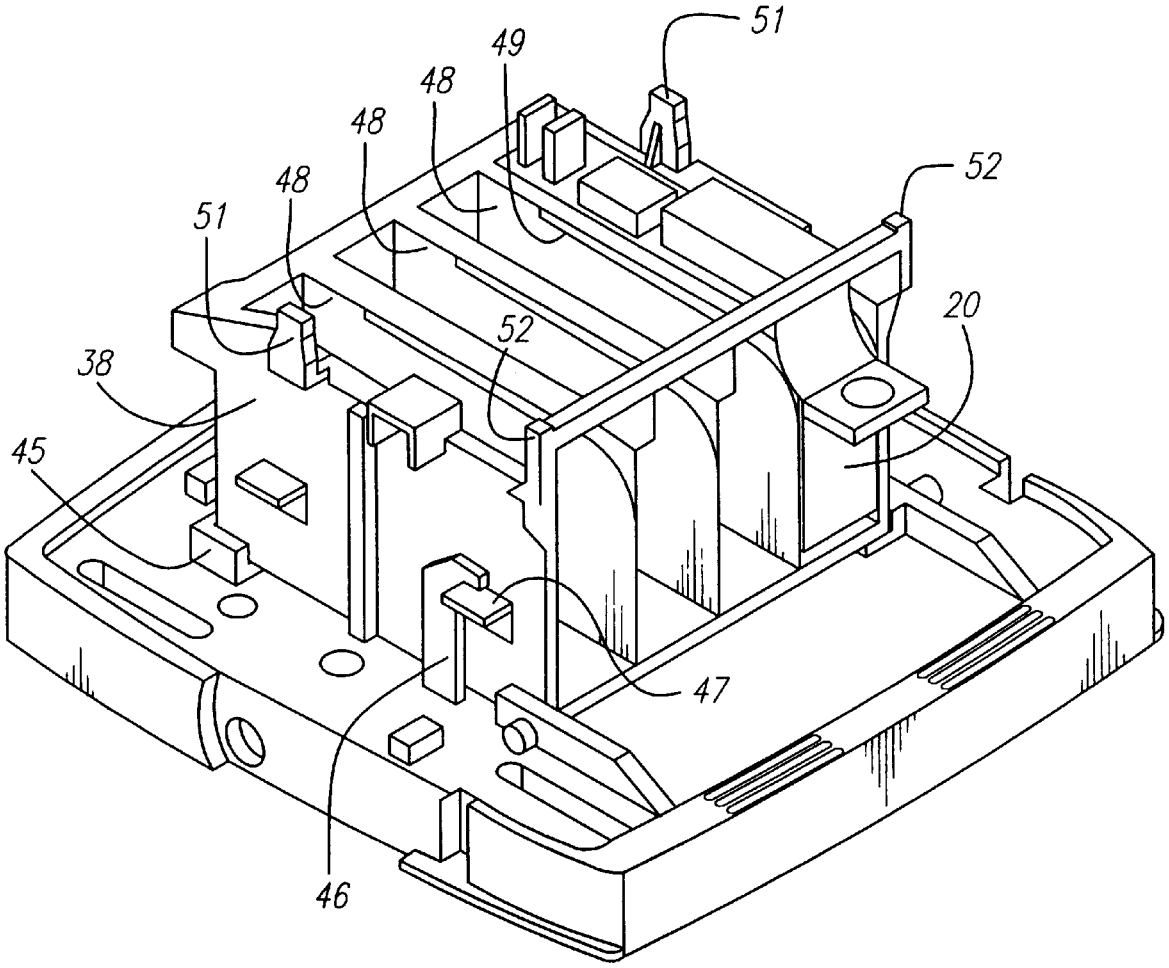
FIG. 10 is a perspective view of a partially assembled garage showing a base plate and a capping housing.

Referring to FIG. 10, the capping housing 38 has four separate slots 48, each for receiving a service module 20. Each slot has a Z datum ridge 49 along a top portion of the slot which engages a corresponding datum ledge 50 (best seen in FIGS. 5 and 8) along both top edges of the service module 20. Each slot comprises an upwardly biased spring arm (not shown) which ensures that each service module 20 snaps into place in its respective slot 48 and is held against the datum ridge 49. Each spring arm is shaped at one end to provide a keying element which interacts with a keying element on the base of a service module 20 to ensure that a particular service module may only be fully inserted into one of the four slots of the capping housing.

The capping housing 38 is substantially similar to the service station carriage 24 of a printer with which the garage may be used. Thus the design of the garage is such that once a service station carriage has been designed and manufactured for a particular type of printer, a garage for cartridges and service modules used with the printer can be rapidly designed and manufactured at low cost. In the present embodiment various aspects of the service station carriage 24 which are specific to its use in a printer need to be altered before it can be utilised as a capping housing 38 in the garage of this embodiment. For example, the sensor arm 27 of the service station carriage 24 must be removed.

Further details of the service station carriage 24 and service module 20 are disclosed in the co-pending commonly assigned application U.S. Ser. No. 08/811,405 filed Mar. 4, 1997 by Brian Canfield et al entitled MANUALLY REPLACEABLE PRINTHEAD SERVICING MODULE FOR EACH DIFFERENT INKJET PRINTHEAD which is incorporated herein by reference.

The cartridge holder 40 of the garage will now be described in detail with reference to FIGS. 11, 12, 13, 14 and 15 which show that the cartridge holder has four separate compartments 53 separated by compartment walls 56, each compartment having X biasing members 54 and downwardly projecting X, Y and Z biasing members 55. Each X biasing member comprises a spring leaf mounted on a compartment wall 56 which biases a cartridge 16 inserted into the compartment in the X direction towards the opposite compartment wall so that datums 32, 57 and 29 of the cartridge are held against corresponding datums (not shown) on the opposite compartment wall. The downwardly projecting biasing members 55 act on the multiple datum 58 of a cartridge 16 to urge the cartridge in all three directions X, Y and Z so that datums 29, 30, 31, 32 and 57 on the cartridge are held against corresponding datums in the compartment. Further details of the biasing members, compartment datums and cartridge datums utilised in the present embodiment of the invention are disclosed in the commonly assigned, issued U.S. Pat. No. 5,642,143 by Rhoads et al, which is incorporated herein by reference.

Each cartridge holder 40 further comprises keying elements consisting of slots 59 within the front wall 60 of the cartridge holder for interacting with keying elements 33 on a cartridge. These keying elements ensure that a particular cartridge can only be inserted into one of the compartments of the garage and thus, in combination with the keying elements provided in each slot of the capping housing, it is ensured that a particular one of a set of cartridges will be mated with the matching one of a set of service modules when stored in the garage. Preferably, the cartridge and service modules are stored in the same order in the garage as the order in which they are mounted respectively within the scanning carriage of a printer and within the service station carriage of a printer. Coloured indicia 61 are provided on an upper portion 62 (seen in FIG. 9) of the cartridge holder 40 which match the coloured indicia on cartridges 16 and service modules 20 to facilitate the correct placement of both within the garage.

Figure 11:
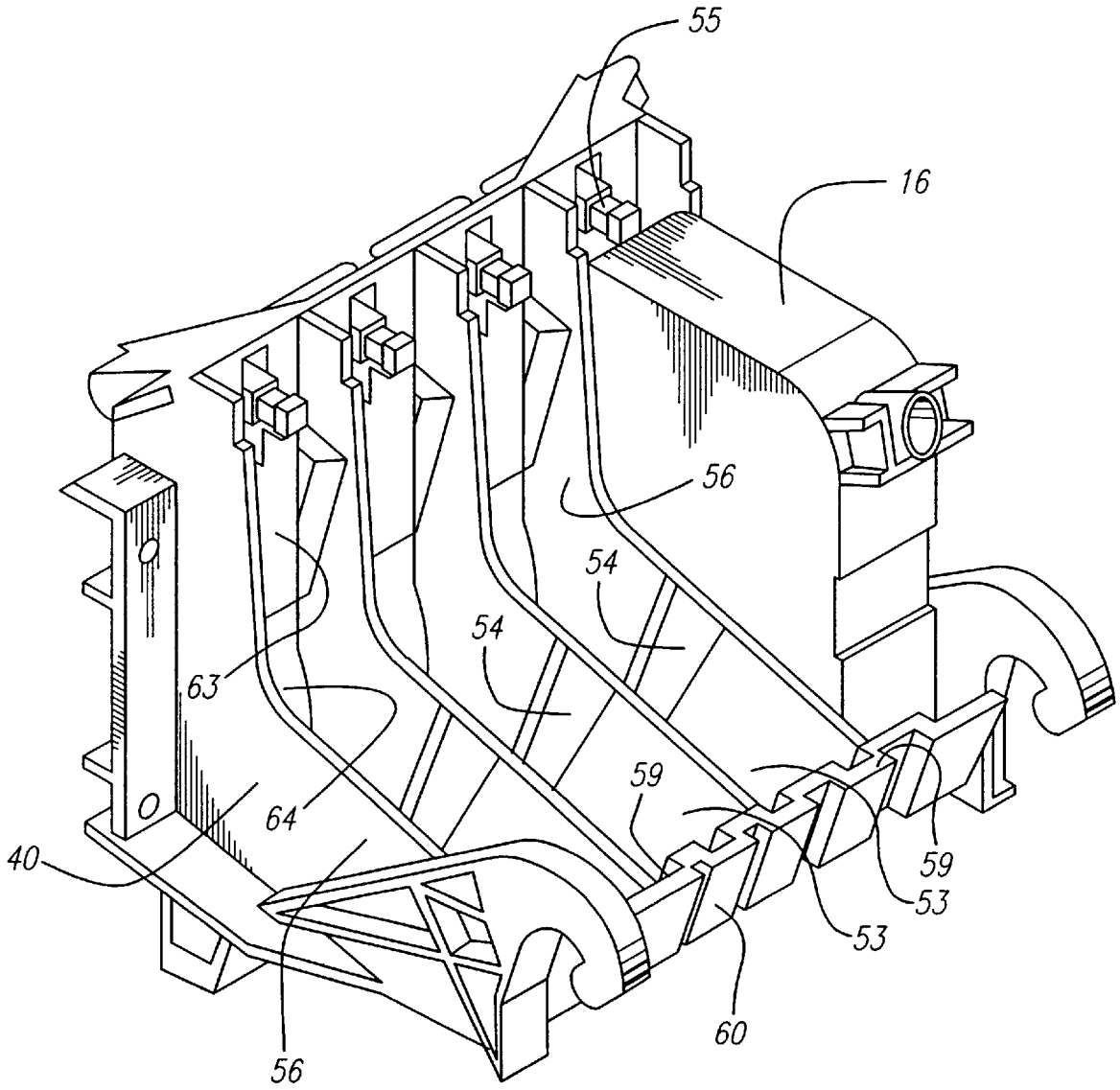
FIG. 11 is a perspective view of a cartridge holder of the garage.

At the rear wall 63 of each compartment 53 of the cartridge holder 40 there is mounted a flexible interconnect circuit 64 for making electrical contact with the electrically conductive interconnect pads 37 of a cartridge 16 placed within the compartment. The flex circuit 64 is connected to the circuitry 15 mounted on the carriage assembly 9 for driving the heater circuits within the cartridge 16. The flex circuit 64 is formed of an insulating tape having numerous traces of conductive material and numerous interconnect pads which protrude from the tape in the form of bumps to make electrical contact with the pads 37 of a cartridge. The flex circuit may be of a unitary construction so that each of the four sections of the flex circuit seen in FIG. 11 are part of the same single piece of insulating tape. Further details of the flex circuit utilised in the present embodiment of the invention are disclosed in the commonly assigned, issued U.S. Pat. No. 5,610,642 by Nobel et al, which is incorporated herein by reference.

Figure 12:
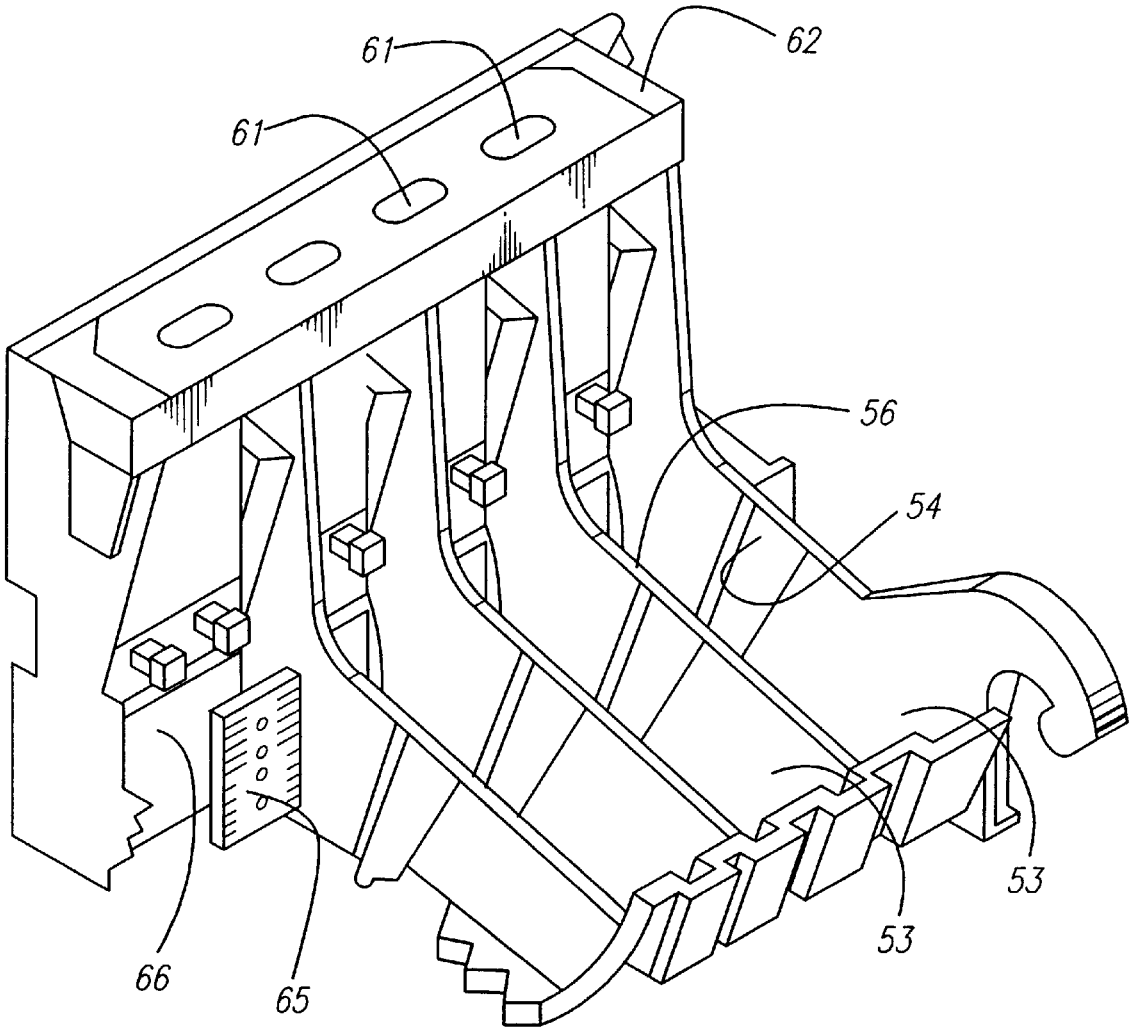
FIG. 12 is a partial section of a perspective view of a cartridge holder of the garage.
Figure 13:
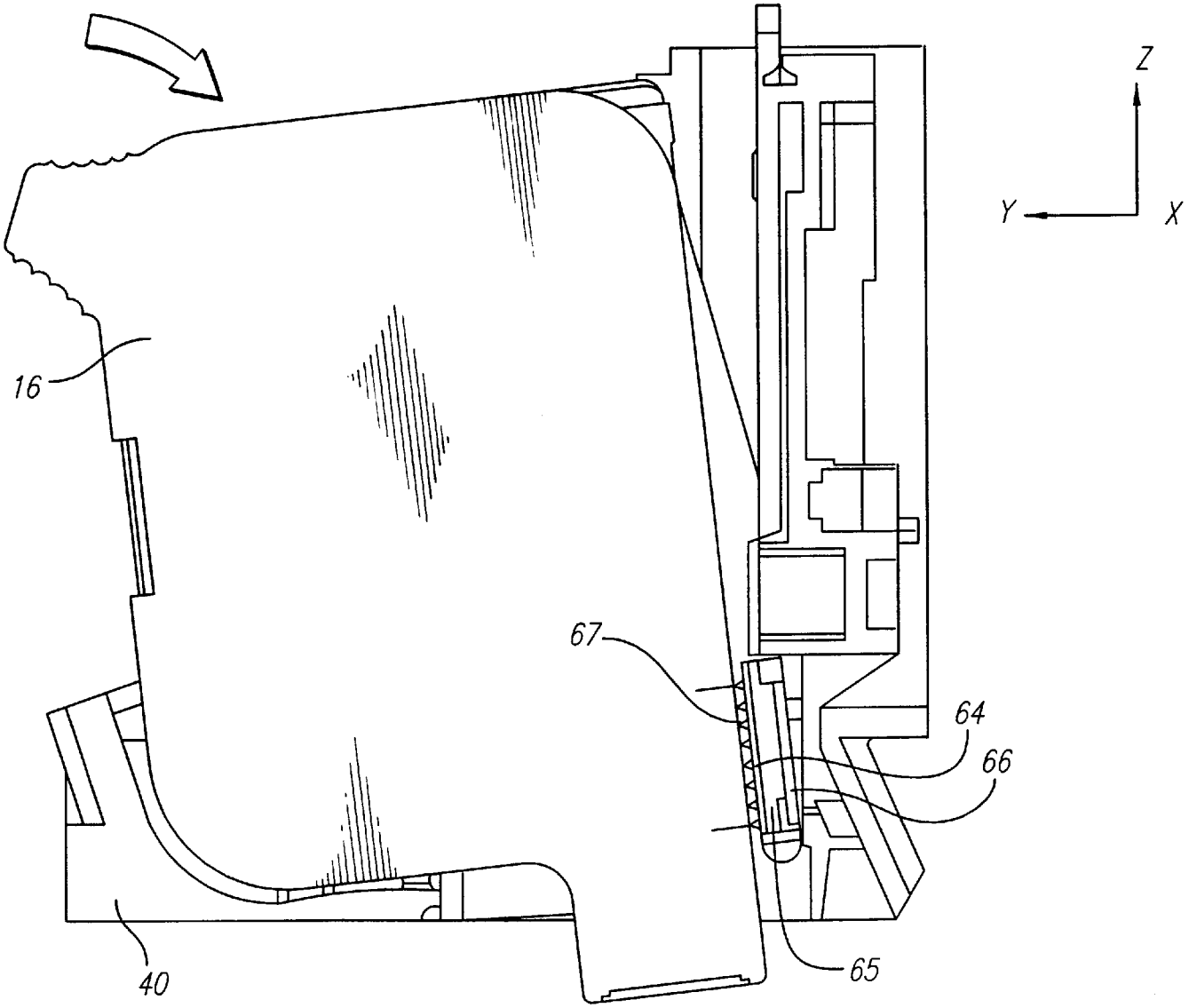
FIG. 13 is a cross-sectional view through a cartridge holder with a partially installed cartridge.
Figure 14:
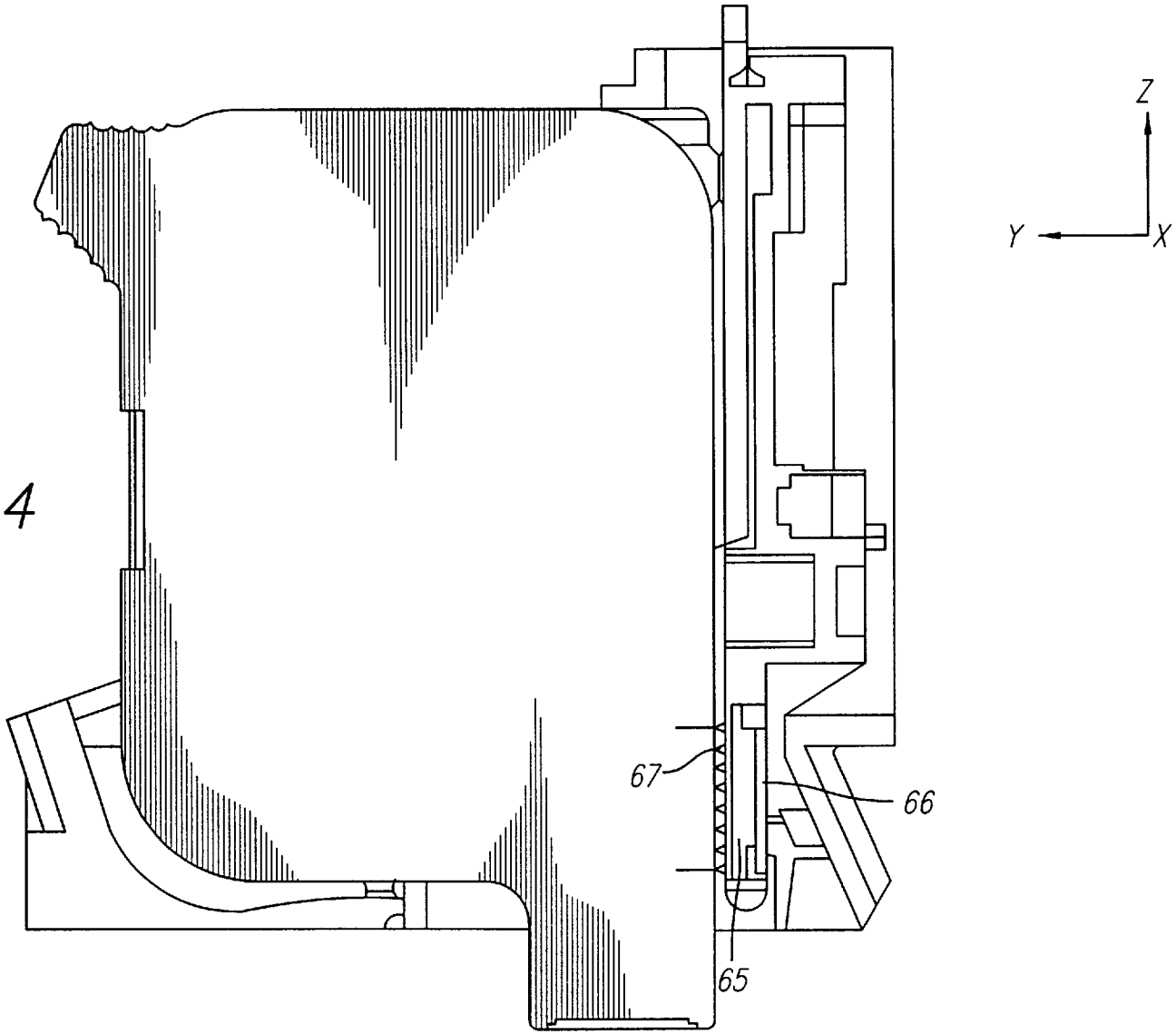
FIG. 14 is a cross-sectional view through a cartridge holder with a fully installed cartridge.

FIG. 12 is a perspective view of the cartridge holder 40 in partial section in which the flex circuit has not been shown so that the mounting elements for the flex circuit may be seen. These mounting elements comprise an elastomeric compensator pad 65 which is pressed against the back of the flex circuit by a biasing plate 66. The biasing plate 66 is mounted for rotation about two axis i.e. a gimbaling action, and is urged forwardly towards the flex circuit by a spring. FIG. 13 is a cross-sectional view through a compartment of the cartridge holder 40 in which a cartridge 16 is partially installed and FIG. 14 is the same view when the cartridge has been fully installed. As the cartridge 16 is initially inserted into the compartment 53 the interconnect pads 37 of the cartridge preliminarily come into contact with the flex circuit 64 as shown in FIG. 13. Even though at this point the cartridge 16 is at a angle to the back wall 63 of the compartment, the flex circuit 64 makes contact with the cartridge due to the biasing gimbal plate 66 rocking to conform with the angle of the cartridge. As the cartridge is fully inserted and thus moves from the position shown in FIG. 13 to the position shown in FIG. 14, the sliding of the interconnect pads 37 of the cartridge against the flex circuit, and particularly against the bumps 67 (shown schematically in FIGS. 13 and 14) of the flex circuit, causes a significant degree of wiping between the two. This wiping action causes any contaminants or corrosion on the interconnect pads 37 of the cartridge to be scraped away. The bumps 67 of the flex circuit remain in intimate mechanical contact with the pads 37 of the cartridge during the storage of the cartridge in the garage due to the pressure of the gimbal plate 66 and elastomeric pad 65 against the back of the flex circuit and thus preserve the efficacy of these pads. Furthermore, on removal of the cartridge from the compartment a similar wiping action is experienced by the pads 37 so that they are fully ready to be reused in a printer. Further details of the flex circuit mounting mechanism utilised in the present embodiment of the invention are disclosed in the commonly assigned, issued U.S. Pat. No. 5,461,482 by Wilson et al, which is incorporated herein by reference.

Figure 15:
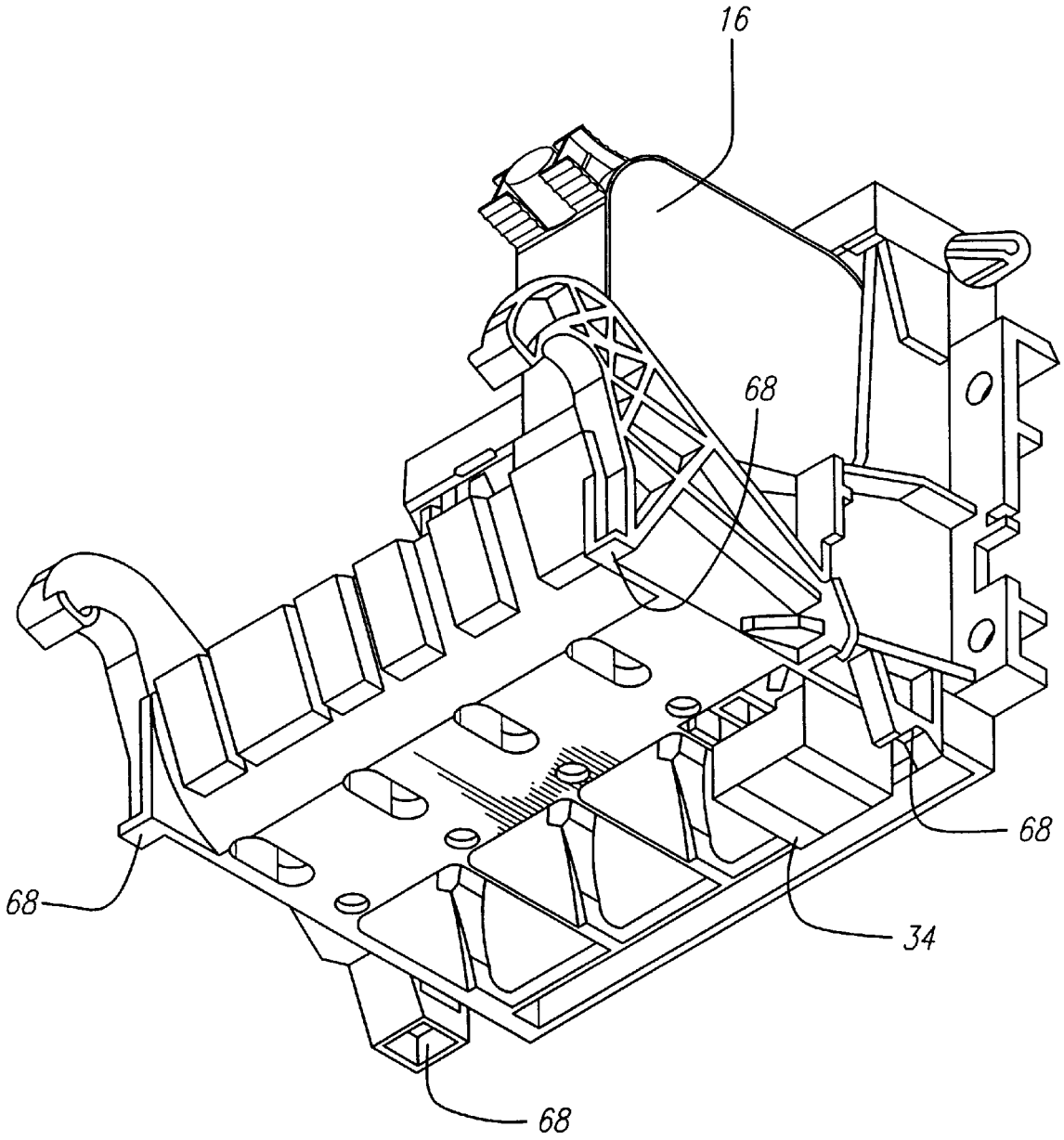
FIG. 15 is a bottom perspective view of a cartridge holder of the garage.

FIG. 15 is a lower perspective view of the cartridge holder 40 with a single cartridge 16 installed in a compartment showing the printhead 34 of the cartridge protruding through the base of the cartridge holder for engagement with a cap 23 of a service module 20 mounted in the capping housing 38 below the cartridge holder. Also shown are referencing surfaces 68 on the underside of the cartridge holder 40 for engagement with the referencing points 51 and 52 on the upper portion of the capping housing.

The cartridge holder 40 of the garage is also substantially similar to the cartridge holder 10 of the scanning carriage assembly 9 of a printer with which the garage may be used. Thus the design of the garage is such that once a cartridge holder has been designed and manufactured for the scanning carriage of a particular type of printer, a garage for cartridges used with the printer can be rapidly designed and manufactured at low cost. In the present embodiment various aspects of the cartridge holder 40 which are specific to its use in a printer need to be altered before it can be utilised in the garage of this embodiment. For example, the mounting for the optical sensor 17 of the scanning carriage assembly must be removed. As will be appreciated considerable effort and expensive is required to design such cartridge holders which control the environment of a cartridge very carefully. It has been appreciated that such these features may be employed within garages to greatly enhance the storage environment of cartridges.

Figure 16:
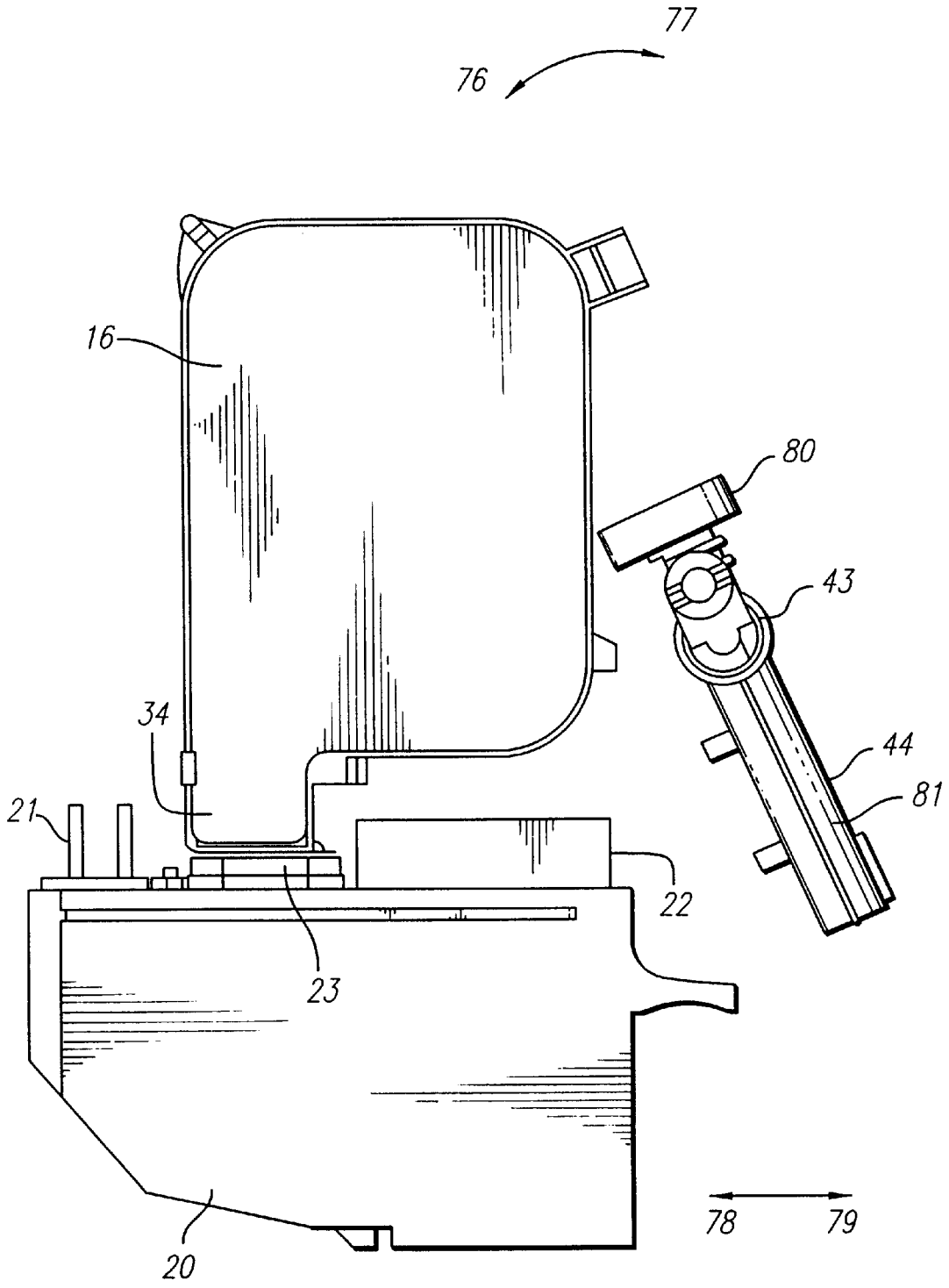
FIG. 16 is a schematic cross-section showing the relative positions of a cartridge and a service module in the garage and a locking arm in a locked position.

The means by which the garage controls the insertion and removal of cartridges and service modules will now be described in detail with reference to FIGS. 9, 16, 17, and 18. FIG. 16 is a schematic drawing showing the relative positions of a cartridge 16 and a service module 20 when fully inserted into a garage. As can be seen the printhead 34 of the cartridge is engaged with the cap 23 of the service module 20 between the wipers 21 and the spittoon 22. The cartridge 16 is inserted into and removed from the garage generally from above along a curved path shown in FIG. 16. The arrowhead 76 shows the direction of insertion of the cartridge and the arrowhead 77 shows the direction of removal of the cartridge. The service module 20 is inserted and removed from the garage from the side, the arrowheads 78 and 79 indicating respectively the direction of insertion and removal of the module. As can be seen from FIG. 16 it is important to control the order or sequence of insertion and removal of the cartridge and service module since if the service module is removed from the garage while the cartridge is in place, not only will the cap 23 be moved across the delicate printhead and nozzle plate of the cartridge, but the wipers will be dragged across the printhead with much greater force than normal. When in use in the service station carriage 24 of the printer, the ends of the wipers 21 are gently rubbed across the printhead which is held away from the service module 20 at about the height of the top of the spittoon 22. However, if the service module were to be removed from the garage prior to the cartridge, the wipers would pass across the printhead when the printhead was only at the height of the top of the cap 23 and would thus would be pressed against the nozzle plate of the printhead with great force. This would also occur if the service module were inserted into the garage after the insertion of the cartridge.

Figure 9:
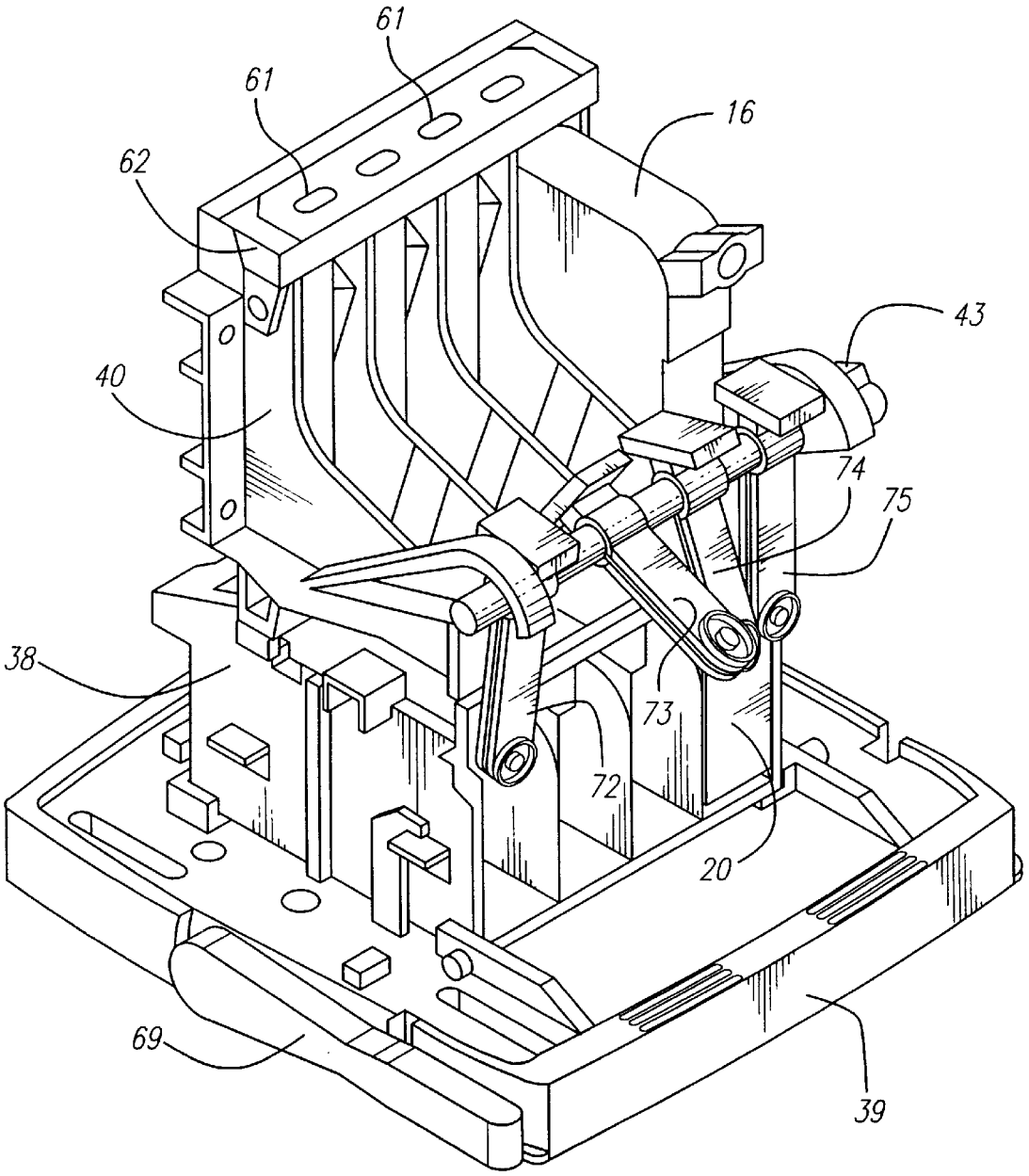
FIG. 9 is a perspective view of the garage without the garage casing showing the assembly of its major components.
Figure 17:
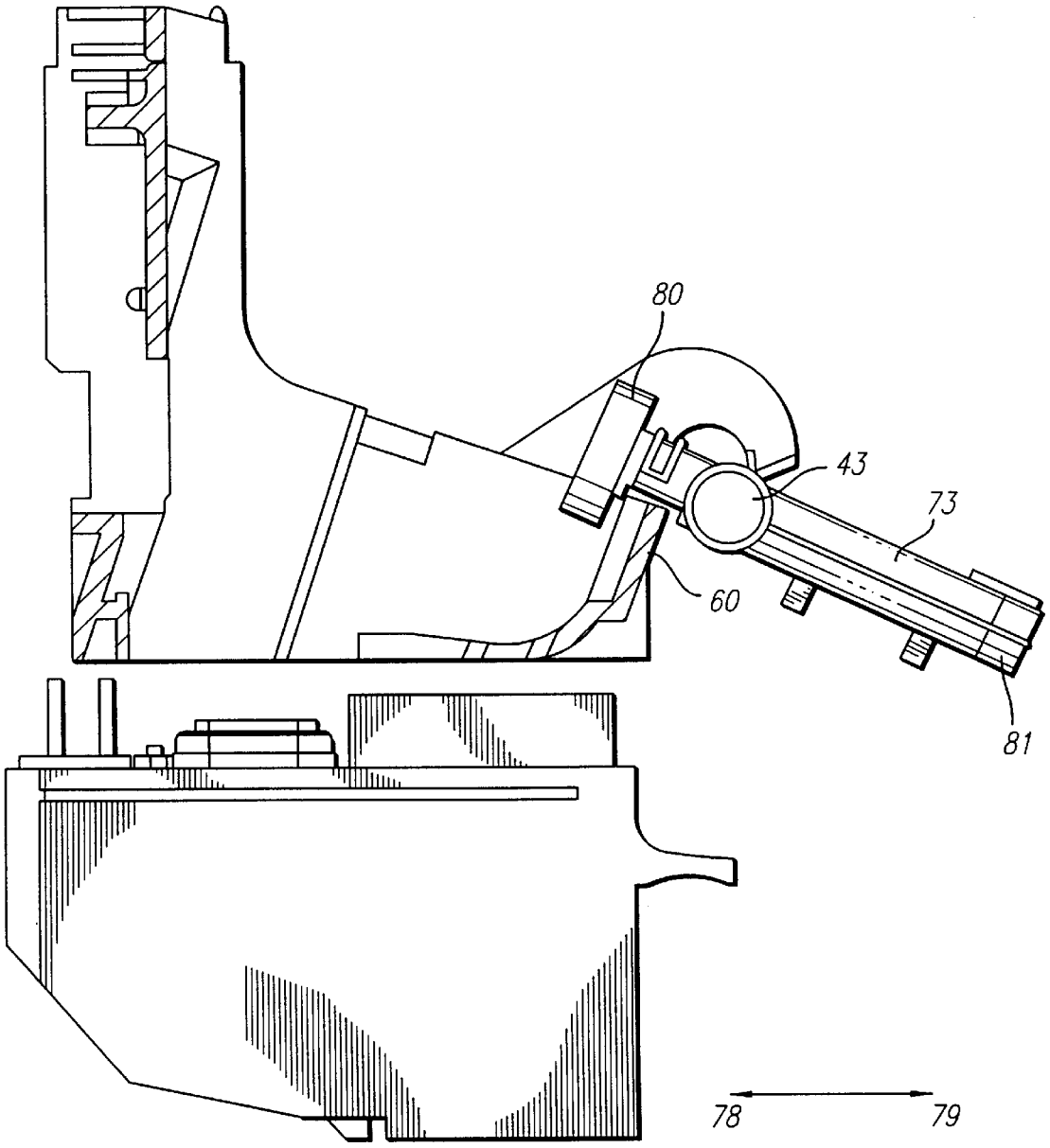
FIG. 17 is a schematic cross-section showing the cartridge holder of the garage, a service module and a locking arm in an unlocked position.

Each of the four locking arms 44, which are numbered 72, 73, 74, and 75 in FIG. 9, are independently rotatable about the bar 43 and have a head portion 80 at a first end of the arm which may abut a cartridge as shown in FIG. 16. Further rotation of the arms 44 (in a counter clockwise sense in FIG. 16) is prevented when the head 80 contacts the cartridge 16. In this locked position the arm prevents the withdrawal of the service module from the garage since if this is attempted the service module would collide with the second end 81 of the arm 44. Furthermore if the cartridge is inadvertently inserted into the garage before its associated service module is inserted, the service module cannot be then installed until the cartridge is removed. Removal of the cartridge is always possible regardless of the position of the arm FIG. 17 is a schematic cross-section through an empty compartment 53 of the garage showing only the cartridge holder, the service module 20 and an arm 73. It can be seen that, once the associated cartridge has been removed from the garage, the arm 73 can be rotated further counter clockwise until the arm contacts the top of the front wall 60 of the cartridge holder 40 just below the head 80 of the arm. In this unlocked position the service module 20 can be both slid into the capping housing of the garage in direction 78 or removed from the capping housing in direction 79. Furthermore a cartridge cannot be inserted into the associated compartment of the cartridge holder when the arm 73 is in this position.

Figure 18:
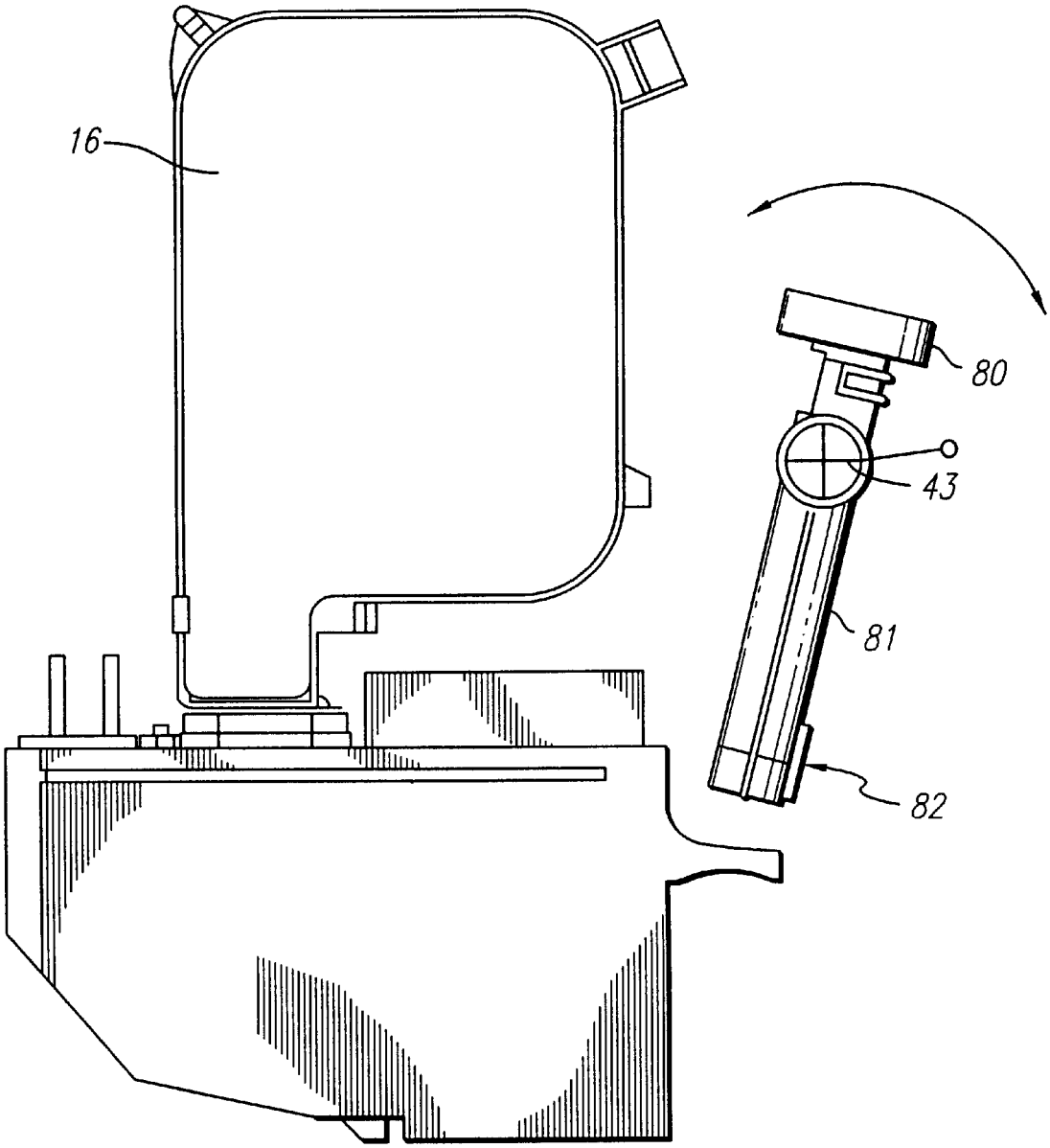
FIG. 18 is a schematic cross-section showing a cartridge, a service module and a locking arm in a third position to urge the service module home.

The arm 72 serves a further function, shown in FIG. 18, of helping a user of the garage to ensure that a service module 20 is fully located within the capping housing of the garage. Once the service module has been inserted into the appropriate slot 48, the end 81 of the arm 72 associated with that slot 48 can be pushed in the direction 82 shown in FIG. 18 so that the service module fully enters the slot and is clicked upwards by the spring arm within the slot. This will ensure that the datum ledge 50 of the service module engages the datum ridge 49 of the capping housing so that the cap of the service module is correctly positioned to receive the printhead of a cartridge. Furthermore, this action ensures that the arm does not obstruct the entry of an associated cartridge into the garage once its service module has been installed.

Figure 19:
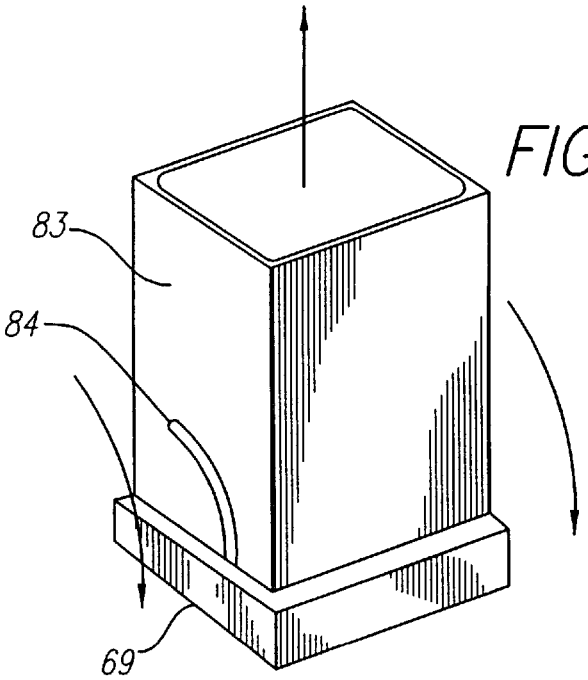
FIGS. 19 to 25 are a sequence of schematic drawings showing the insertion and removal of service modules and cartridges into a garage.
Figure 20:
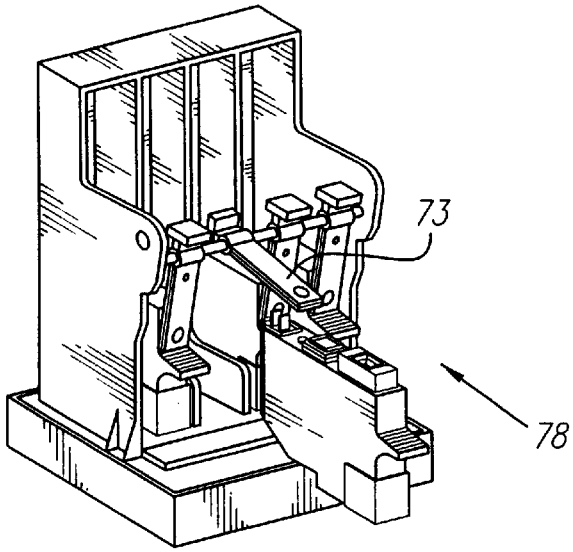
Figure 21:
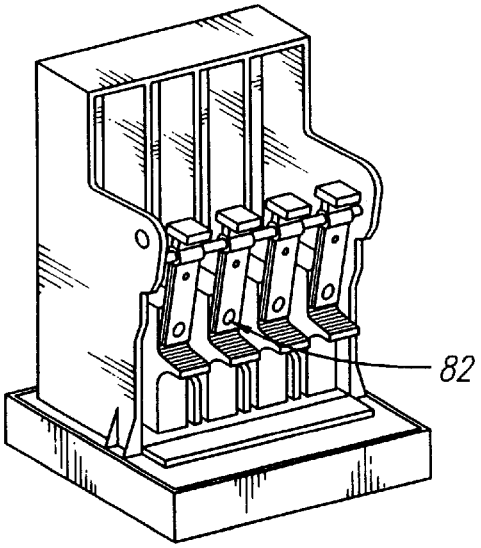

The loading and unloading of the garage will now be described with reference to FIGS. 19 to 25. FIG. 19 shows the garage with its protective cover 83 in place. To load the garage the two levers 69 on either side of the base plate 39 are rotated from their raised locked positions to their lowered unlocked positions and the cover 83 is removed. A locking arm 73 is raised, as shown in FIG. 20, to allow its associated service module (removed from a printer) to be inserted into the matching colour coded slot in the capping housing. Then, as FIG. 21 shows, the arm 73 is lowered and its end 81 is pushed to contact the service module which clicks fully into place. These steps are repeated for the three remaining service modules of a set.

Figure 22:
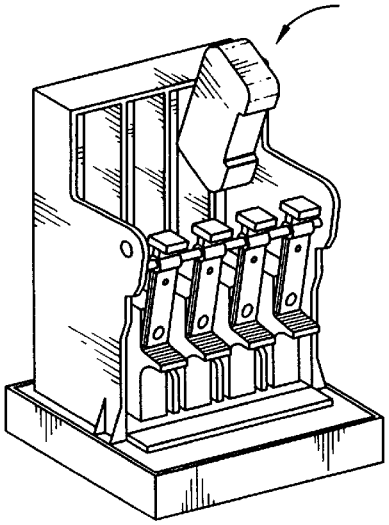
Figure 23:
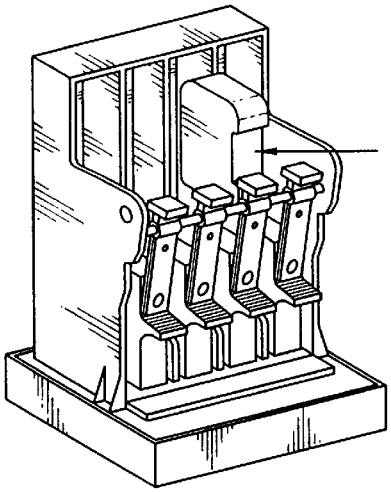
Figure 24:
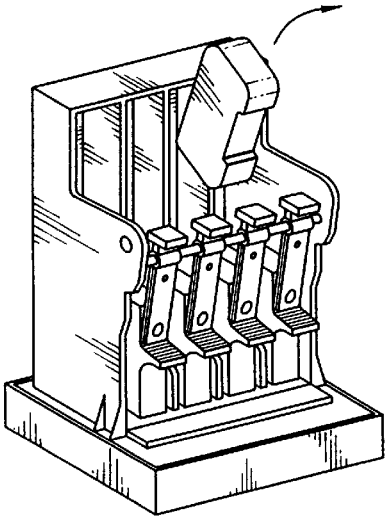
Figure 25:
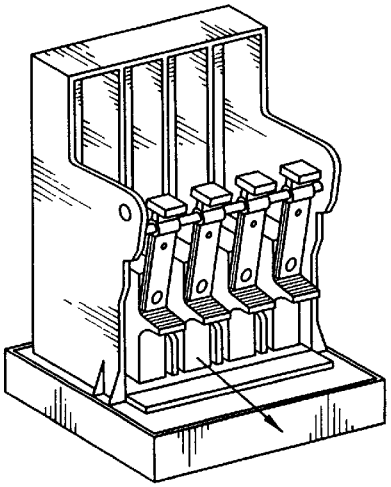

The arms 44 are now in a position to allow the insertion of cartridges into the garage This is achieved by placing each cartridge into the appropriate colour coded compartment and pressing lightly downwards and towards the rear of the garage until it clicks into place, as shown in FIGS. 22 and 23. As the cartridge is pressed home its electrical interconnect pads are cleaned by the flex circuit of the garage and its printhead is accurately capped by a cap matched to the cartridge. Finally the cover 83 is replaced and the two levers 69 are raised to their locked position In order to remove cartridges and service modules from the garage, once the cover 83 has been removed, each cartridge is removed by pressing lightly downwards and pulling the cartridge upwards and away from the garage as shown in FIG. 24. Once the cartridge has been removed from a particular compartment, the locking arm 44 associated with the compartment can be moved upwards to its unlocked position and the associated service module can be removed from the garage as shown in FIG. 25.

We claim:

1. A storage container for storing at least one inkjet cartridge removed from an inkjet printer carriage, each said at least one inkjet cartridge having an ink-ejection printhead, and for storing capping means associated with each said at least one inkjet cartridge respectively; said storage container comprising:

a cartridge housing for transfer of said at least one inkjet cartridge, the word "transfer" being defined as an operation selected from the group consisting of:
manual insertion,
manual removal, and
both manual insertion and manual removal;

a capping housing for transfer of said associated capping means; and ordering means for maintaining correct order of transfer, with respect to said storage container, of inkjet cartridges and capping means, the terminology "correct order of transfer" being defined as a sequence selected from the group consisting of:
insertion of a particular capping means into said capping housing prior to insertion of the associated inkjet cartridge into said cartridge housing,
removal of a particular inkjet cartridge from said cartridge housing prior to removal of the associated capping means from said capping housing, and
both said capping-means insertion and said inkjet-cartridge removal.

2. A storage container as claimed in claim 1, wherein:

said ordering means control both order of insertion and order of removal.

3. A storage container as claimed in claim 1, wherein:

said ordering means comprise an arm that is movable between:

a first position permitting transfer of the capping means with respect to said capping housing, and a second position in which said arm obstructs the transfer of said capping means; and abutment of said arm against the at least one inkjet cartridge prevents movement of said arm from said second position to said first position.

4. A storage container as claimed in claim 3, wherein:

said arm is pivotally mounted so as to be rotatable between said first and second positions.

5. A storage container as claimed in claim 4, wherein:

a first end of said arm abuts the at least one inkjet cartridge when the arm is in said second position, and said first end comprises a head portion which extends toward said at least one inkjet cartridge.

6. A storage container as claimed in claim 4, wherein:

a second end of said arm abuts said capping means, when said arm is rotated from said second position toward said first position, so as to fully insert said capping means if said capping means are partially inserted.

7. A storage container as claimed in claim 3, wherein:

a first end of said arm when said arm is in said first position prevents insertion of the at least one associated inkjet cartridge into the cartridge housing.

8. A storage container as claimed in claim 1, for use when said at least one inkjet cartridge is a plurality of inkjet cartridges, wherein:

said ordering means independently control the order of transfer, with respect to said storage container, of each inkjet cartridge of said plurality of inkjet cartridges and the associated capping means.

9. A storage container as claimed in claim 8, wherein:

said ordering means comprise a plurality of arms, each arm of said plurality of arms being respectively associated with one inkjet cartridge of said plurality of inkjet cartridges and the associated capping means, and being independently movable between:

a first position permitting transfer of the associated capping means with respect to said capping housing, and a second position obstructing transfer of said associated capping means; and abutment of each arm, of said plurality of arms, against the associated inkjet cartridge prevents arm movement from said second position to said first position.

10. A storage container as claimed in claim 1, further comprising:

a base plate for mounting said capping housing, a casing for mounting said cartridge housing, and a protective cover.

11. A storage container for storing at least one inkjet cartridge removed from an inkjet printer carriage, each said at least one inkjet cartridge having an ink-ejection printhead, and for storing capping means associated with each said at least one inkjet cartridge respectively; said storage container comprising:

a cartridge housing for transfer of said at least one inkjet cartridge, the word "transfer" being defined as an operation selected from the group consisting of:
manual insertion,
manual removal, and
both manual insertion and manual removal;

a capping housing for transfer of said associated capping means; and locking means for, when the at least one inkjet cartridge is located in said cartridge housing, substantially preventing movement of the associated capping means.

12. A storage container as claimed in claim 11, wherein:

when the at least one inkjet cartridge is located in the cartridge housing, the locking means also prevent insertion of the associated capping means into the capping housing.

13. A method of storing in a storage container at least one inkjet cartridge, each said at least one inkjet cartridge having an ink-ejection printhead, and of storing service-module means associated with said at least one inkjet cartridge respectively, said service-module means having capping means; said method comprising the steps of:

removing the at least one inkjet cartridge from an inkjet printer, removing from the inkjet printer the service-module means associated with said removed at least one inkjet cartridge, firstly manipulating an ordering device on the storage container to allow insertion of said associated service-module means, and inserting said associated service-module means into the storage container, and then secondly manipulating said ordering device to allow insertion of said at least one inkjet cartridge and inserting said inkjet cartridge into the storage container so that the printhead of the at least one cartridge engages and is held against the capping means of said associated service-module means.

14. A method of storing in a storage container at least one inkjet cartridge, each said at least one cartridge having an ink-ejection printhead, and of storing service-module means associated with said at least one inkjet cartridge, said associated service-module means having capping means; said method comprising the steps of:

firstly manipulating an ordering device to allow removal of the at least one inkjet cartridge, and removing said at least one inkjet cartridge from the storage container so that the printhead of the cartridge disengages the capping means of the at least one service-module means, and then secondly manipulating said ordering device on the storage container to allow removal of said service-module means, and removing said service-module means from the storage container.

* * * * *